US005134337A

United States Patent [19]

Kongslie et al.

[11] Patent Number: 5,134,337

[45] Date of Patent: Jul. 28, 1992

[54] PROJECTION LENS ASSEMBLY FOR PLANAR ELECTRON SOURCE

[75] Inventors: Keith F. Kongslie, Beaverton; Gary A. Nelson, Portland, both of Oreg.; Duncan F. Hughes, Woodlyn, Pa.

[73] Assignee: Tektronix, Inc., Wilsonville, Oreg.

[21] Appl. No.: 726,139

[22] Filed: Jul. 5, 1991

Related U.S. Application Data

[63] Continuation of Ser. No. 462,198, Jan. 9, 1990, abandoned.

[51] Int. Cl.[5] ..... H01J 29/56; H01J 29/62; H01J 43/02

[52] U.S. Cl. ..... 313/400; 313/435; 313/437; 313/105 CM; 315/15; 315/17

[58] Field of Search ..... 313/399, 401, 429, 453, 313/400, 434, 435, 437, 103 CM, 105 CM; 315/15, 17

[56] References Cited

U.S. PATENT DOCUMENTS

| | | | |
|---|---|---|---|
| 2,163,546 | 6/1939 | Clothier et al. | 313/400 |
| 2,821,637 | 1/1958 | Roberts et al. | 313/103 CM X |
| 3,128,408 | 4/1964 | Goodrich et al. | 313/103 CM |
| 3,772,551 | 11/1973 | Grant | 313/105 CM X |
| 4,752,714 | 6/1988 | Sonneborn et al. | 313/429 |
| 4,808,879 | 2/1989 | Maxson et al. | 313/421 |
| 4,814,599 | 3/1989 | Wang | 313/103 CM X |

OTHER PUBLICATIONS

Schlesinger, Kurt, "An Electrostatic Image Tube with Planar Photocathode," IEEE Transactions on Electron Devices, vol. Ed. 16, No. 3, pp. 284–292 (Mar. 1969).

A. A. van Gorkum and L. C. M. Beirens, "Experiments on Eliminating Spherical Aberration in Electron Guns Using Aspherical Mesh Lenses," vol. 4, No. 5, pp. 2297–2306 (Sep./Oct. 1986).

Nobuyoshi Koshida, "Effects of Electrode Structure on Output Electron Distribution of Microchannel Plates", Rev. Sci. Instrum. 57(3), pp. 354–358 (Mar. 1986).

John H. Sonneborn and Kenneth W. Hawken, "Design of a Microchannel Plate CRT for a General-Purpose Oscilloscope," SID '86 Digest, pp. 240–243 (1986).

*Primary Examiner*—Palmer C. DeMeo

*Attorney, Agent, or Firm*—John D. Winkelman; Mark M. Meininger

[57] ABSTRACT

A projection lens assembly (10) projects onto a display screen (38) electrons emitted from an output side (86) of an electron multiplier such as, for example, a microchannel plate (70). The projection lens assembly includes a dome-shaped mesh element (16) that is concave as viewed from the display screen. The mesh element is positioned between the microchannel plate and a filter element (20) having a beam-limiting aperture (22). The mesh element is of an aspherical shape that allows the projection lens assembly to project the electrons toward the display screen with substantially no spherical aberration, thereby forming near the beam-limiting aperture an electron beam crossover of small diameter. The beam-limiting aperture is formed with a relatively small diameter that allows the filter element to block electrons of energies outside a preselected range of energy values, thereby reducing chromatic aberration in the image formed on the display screen.

18 Claims, 3 Drawing Sheets

PROJECTION LENS ASSEMBLY FOR PLANAR ELECTRON SOURCE

This application is a continuation of application Ser. No. 07/462,198 filed Jan. 9, 1990, and now abandoned.

TECHNICAL FIELD

The present invention relates to electron projection lens assemblies and, in particular, to such a lens assembly that projects electrons emanating from a planar electron source such as a microchannel plate.

BACKGROUND OF THE INVENTION

Some cathode-ray tubes include a microchannel plate positioned immediately adjacent and parallel to a display screen to enhance the brightness of an image formed thereon. For example, U.S. Pat. No. 4,752,714 of Sonneborn et al. for "Decelerating and Scan Expansion Lens System for Electron Discharge Tube Incorporating a Microchannel Plate," describes such a tube in which a beam of electrons emitted from a point-type electron source propagates generally along a beam axis. The beam is scanned across an input side of the microchannel plate by means of a pair of deflection structures in cooperation with an electrostatic scan expansion lens system. The scan expansion lens system is positioned between the deflection structures and the microchannel plate to magnify the deflection angle provided by the deflection structures. Accordingly, the scan expansion lens system receives electrons emitted from the point-type electron source and directs them toward the microchannel plate.

In response to the electron beams scanned across its input side, the microchannel plate provides at an output side an increased number of electrons that propagate toward the display screen. Each location on the microchannel plate is aligned in opposed relation to a corresponding location on the display screen. An enlarged cross-sectional view of such an arrangement is shown by Sonneborn et al. in FIG. 1 of "Design of a Microchannel Plate CRT for a General-Purpose Oscilloscope," pp. 240–243, SID 1986 Digest. The microchannel plate in such a cathode-ray tube is, therefore, of a diagonal size substantially the same as that of the display screen.

Cathode-ray tubes of this type suffer from at least two disadvantages. Microchannel plates are relatively expensive and have a cost that is directly proportional to their diagonal size. In addition, microchannel plates with a diagonal size greater than about 4 cm. are difficult to manufacture. As a result, the diagonal size of the display screen in such a tube is typically less than about 2.5 cm. because of the expense of and difficulty in manufacturing microchannel plates of a larger size.

SUMMARY OF THE INVENTION

An object of the present invention is, therefore, to provide a cathode-ray tube employing a planar electron source such as a microchannel plate.

Another object of this invention is to provide such a tube in which a projection lens assembly is capable of projecting electrons emitted from the planar electron source.

A further object of this invention is to provide such a tube in which the display screen is of a diagonal size greater than that of the planar electron source.

In a preferred embodiment of the present invention, a cathode-ray tube includes a point-type electron source that directs a beam of electrons generally along a central axis in the tube. A pair of deflection structures deflect the beam in directions transverse to the central axis such that the beam forms symbology (e.g., an alphanumeric character or a signal waveform) on a planar input side of a microchannel plate. An increased number of electrons are emitted from a planar output side of the microchannel plate at locations that are aligned with the input side locations scanned by the electron beam. Accordingly, the output side of the microchannel plate functions as a planar electron source.

A projection lens assembly receives the electrons emitted from the output side of the microchannel plate and projects them onto the display screen. The projection lens assembly includes a dome-shaped mesh element that is concave as viewed from the display screen. The mesh element is positioned between the microchannel plate and a filter element having a beam-limiting aperture. A potential difference is applied between the output side of the microchannel plate and the mesh element to generate electric fields that direct the electrons toward the central axis in the vicinity of the beam-limiting aperture.

The mesh element is of an aspherical shape such that the electric fields function to reduce spherical aberration in the image formed on the display screen. In particular, the electrons emitted from different radial positions on the microchannel plate are converged by the electric fields toward the central axis at locations very close to the beam-limiting aperture. The beam-limiting aperture may be formed, therefore, with a relatively small diameter without causing the filter element to block electrons emitted from different radial positions on the microchannel plate.

The electrons emitted by the microchannel plate have energies within a range of about 0 to 120 electron volts. Electrons of different energies are directed by the electric fields toward different locations along the central axis. As a result, the relatively small diameter of the beam-limiting aperture allows the filter element to block electrons of energies outside a preselected range of energy values, thereby reducing chromatic aberration in the image formed on the display screen.

The projection lens assembly magnifies onto the display screen the symbology formed on the input side of the microchannel plate. As a result, the microchannel plate can be of a size substantially less than that of the display screen, thereby reducing the cost of the microchannel plate and the cathode-ray tube. Moreover, the size of the display screen in such a tube is not limited to the size at which affordable microchannel plates can be manufactured.

DETAILED DESCRIPTION OF PREFERRED EMBODIMENT

Figure 1:
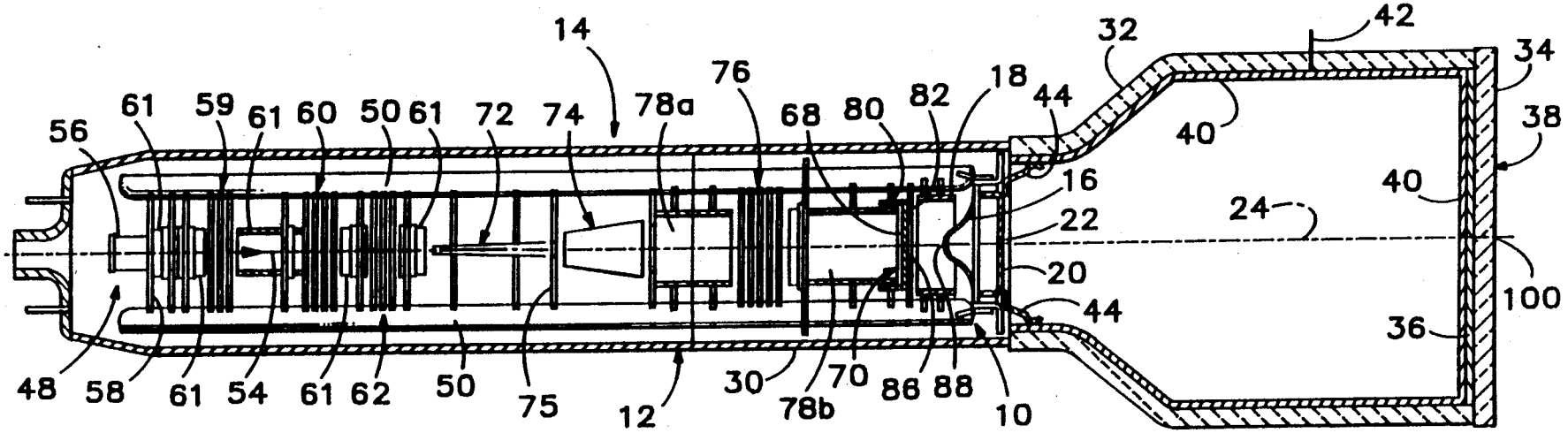
FIG. 1. is a schematic longitudinal sectional view of a cathode-ray tube incorporating the projection lens assembly of the present invention.

FIG. 1 shows a projection lens assembly 10 of the present invention contained within an evacuated envelope 12 of a cathode-ray tube 14. Projection lens assembly 10 includes a dome-shaped mesh element 16 positioned between a tubular electrode element 18 and a beam energy filter element 20 having a beam-limiting aperture 22. Mesh element 16 is secured to filter element 20 in which aperture 22 is positioned in alignment with a central longitudinal axis 24. Mesh element 16, tubular electrode element 18, and filter element 20 are axially aligned with axis 24.

Envelope 12 includes a tubular glass neck 30, a ceramic funnel 32, and an optically transparent glass faceplate 34 bonded together with glass seals (not shown). A layer 36 of phosphor material is deposited on the inner surface of faceplate 34 to form a display screen 38. An electron-transparent aluminum film 40 is deposited by evaporation on the inner surface of phosphor layer 36 and the inner surface of ceramic funnel 32 to provide a high-voltage electrode for display screen 38. A high voltage potential of about +21 kilovolts is delivered to aluminum film 40 via a high voltage terminal 42 that extends though ceramic funnel 32. A spring-type contact 44 is attached to filter element 20 and contacts aluminum film 40, thereby applying to mesh element 16 and filter element 20 the high-voltage potential present on aluminum film 40.

A point-type electron source 48 is supported at one end of cathode-ray tube 14 by glass rods 50. Electron source 48 produces a beam of electrons that propagate generally along central axis 24 in a direction 54 toward display screen 38. Electron source 48 includes a cathode or emitter 56 and a beam current control grid 58 that cooperate to form an electron beam. Emitter 56 receives a potential of between 0 and +120 volts, and control grid 58 is grounded. The difference between the potentials applied to emitter 56 and control grid 58 functions to control the magnitude of the current carried by the electron beam. In addition, the difference between the potentials converges the electron beam toward central axis 24 to form a beam crossover in the vicinity of control grid 58.

A demagnifier lens 59 forms a demagnified image of the beam crossover, and an astigmatism correction lens 60 corrects astigmatism in the electron beam. Demagnifier lens 59 is of the einzel type and receives electrons that propagate through each of five anode tubes 61.

A main focus lens 62 focuses the demagnified electron beam crossover image toward a planar input means or side 68 of an electron multiplier such as, for example, a microchannel plate 70. A vertical beam deflection structure 72 and a horizontal beam deflection structure 74 deflect the electron beam in directions transverse to central axis 24 in accordance with symbology (e.g. an electrical signal waveform or an alphanumeric character) to be rendered on display screen 38. An isolation wafer 75 is positioned between deflection structures 72 and 74 to substantially reduce electrical interference between them.

The deflected electron beam propagates through a geometry correction lens 76 and a pair of drift tube sections **78*a* and 78*b*. In response to the electrons that strike its input side 68, microchannel plate 70 provides at its planar output means or side 86 an increased number of electrons that are projected onto display screen 38 by projection lens assembly 10. Correction lens 76 is of the octupole type and functions to reduce pin cushion-type and barrel-type distortion that cause curvature in images of straight lines rendered at the periphery of display screen 38. Microchannel plate 70 is positioned between and supported by a mounting cylinder 80 and a support wafer 82**.

Figure 2:
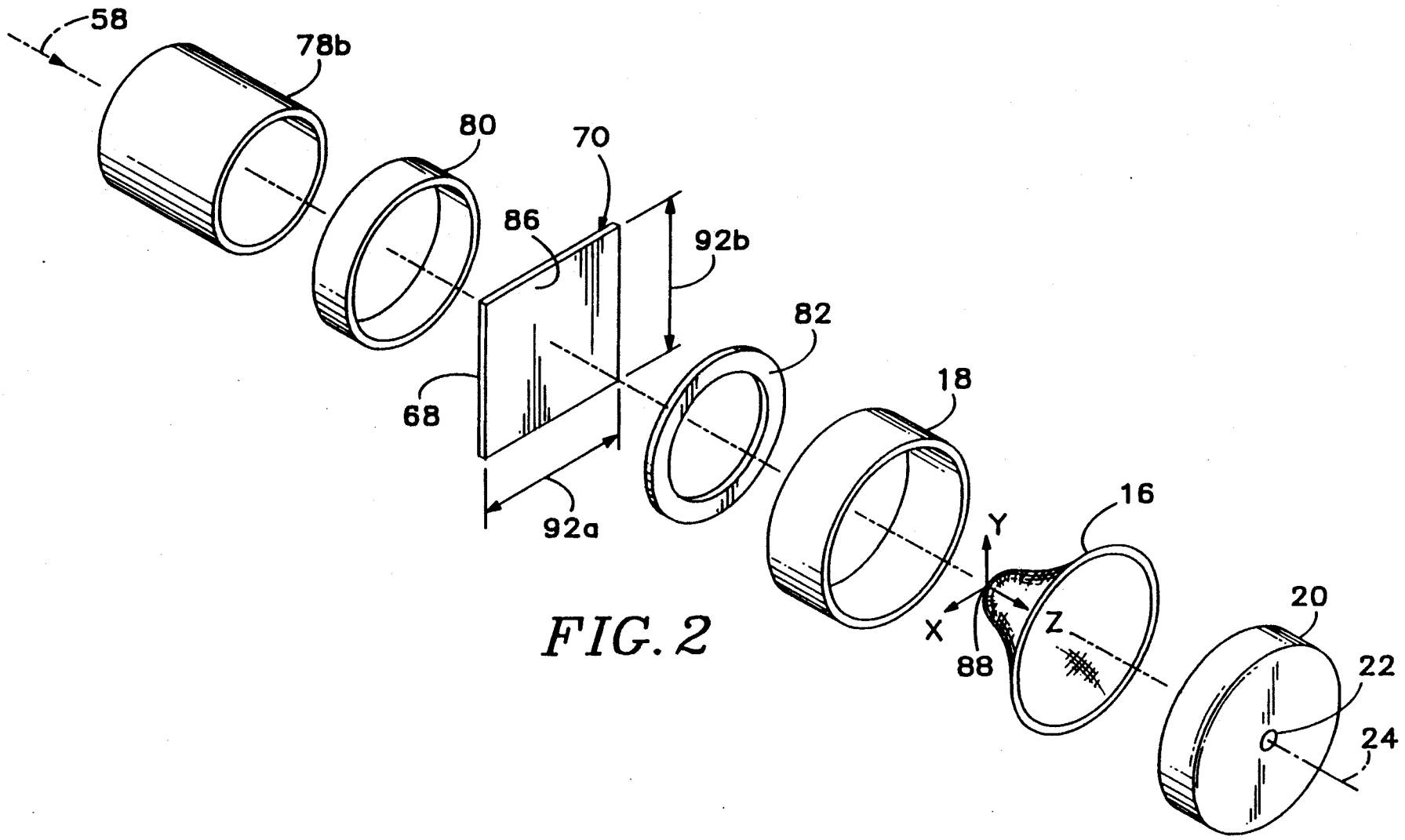
FIG. 2 is an exploded view showing the components of the projection lens assembly shown in the cathode-ray tube of FIG. 1.
Figure 3:
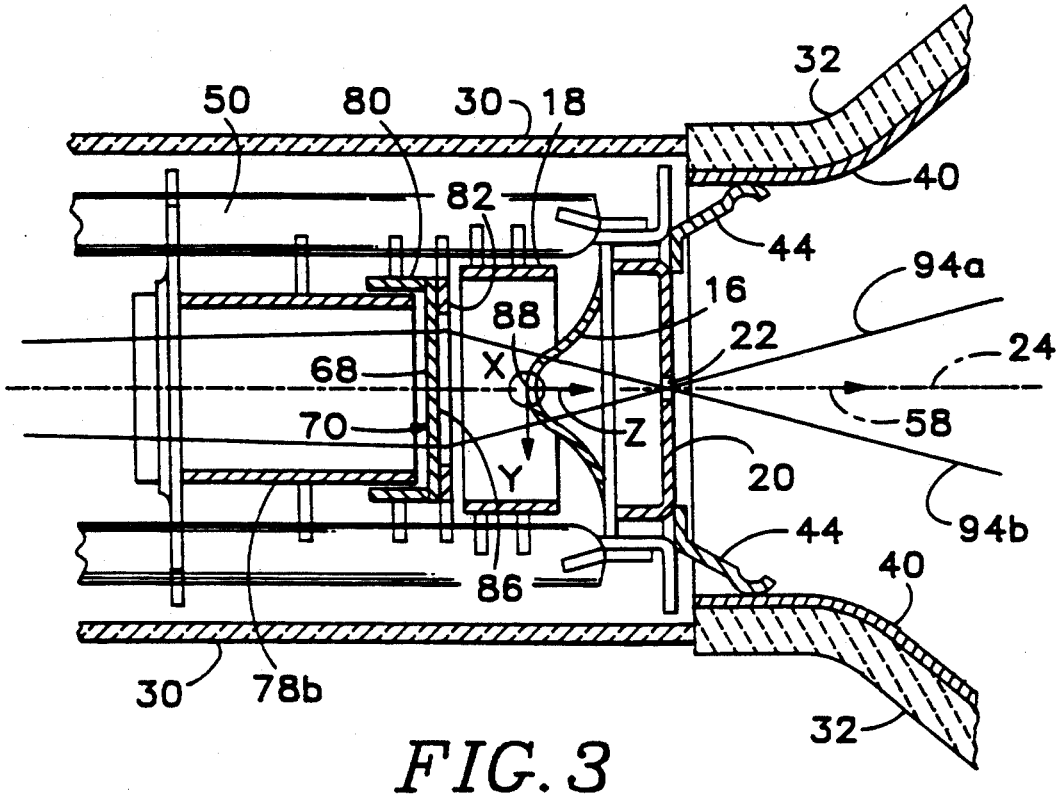
FIG. 3 is an enlarged side elevation view of the projection lens assembly of FIG. 1.

With reference to FIGS. 2 and 3, mesh element 16 is of a concave aspherical shape as viewed from display screen 38 and has an apex 88 overlapped by electrode element 18. Mesh element 16 is rotationally symmetric about central axis 24 and has a two-dimensional contour 90 (shown in bold in FIG. 2) that is represented in a preferred embodiment by an equation:

$$z=(0.425\,y)+(6.481\,y^3)$$

in which the variables y and z refer to the y- and z-axes of a coordinate system calibrated in centimeters and having an origin positioned at the intersection of apex 88 and central axis 24.

Microchannel plate 70 has dimensions **92*a* and 92*b* of about 1.25 centimeters and 1.0 centimeters in directions parallel to the x- and y-axes, respectively. Display screen 38 has dimensions of 8.5 centimeters and axes, respectively. Projection lens assembly 10 provides, therefore, magnification by a factor of 6.8 of the symbology formed on input side 68 of microchannel plate 70. It will be appreciated, however, that projection lens assembly 10** could be adapted to provide either magnification of a different magnitude, demagnification, or no magnification.

In a preferred embodiment, drift tube section **78*b* receives a potential of zero volts, and input side 68 of microchannel plate 70 receives a potential of −30 volts. Output side 86 of microchannel plate 70 and electrode element 18 receive from a biasing means or source (not shown) potentials of +1700 volts and +3500 volts, respectively. Mesh element 16, filter element 20 and aluminum film 40** receive the high voltage potential of about +21 kilovolts.

The potential difference between mesh element 16 and output side 86 of microchannel plate 70 functions to converge toward beam-limiting aperture 22 electron beams such as, for example, beams **94*a* and 94*b*, which emanate from different locations on output side 86. Beams 94*a* and 94*b* cross over central axis 24 in the vicinity of aperture 22 and are projected toward display screen 38**.

The aspherical contour of mesh element 16 allows lens assembly 10 to project the electron beams toward display screen 38 with substantially no spherical aberration to about a third order approximation. As a result, electron beams emanating from different radial positions on output side 86 intersect central axis 24 over a relatively small range of positions along central axis 24, thereby forming an electron beam crossover of relatively small diameter. In the preferred embodiment, the magnitude of the potential applied to electrode 18 may be adjusted to align the electron beam crossover along axis 24 with aperture 22 in filter element 20.

Figure 4:
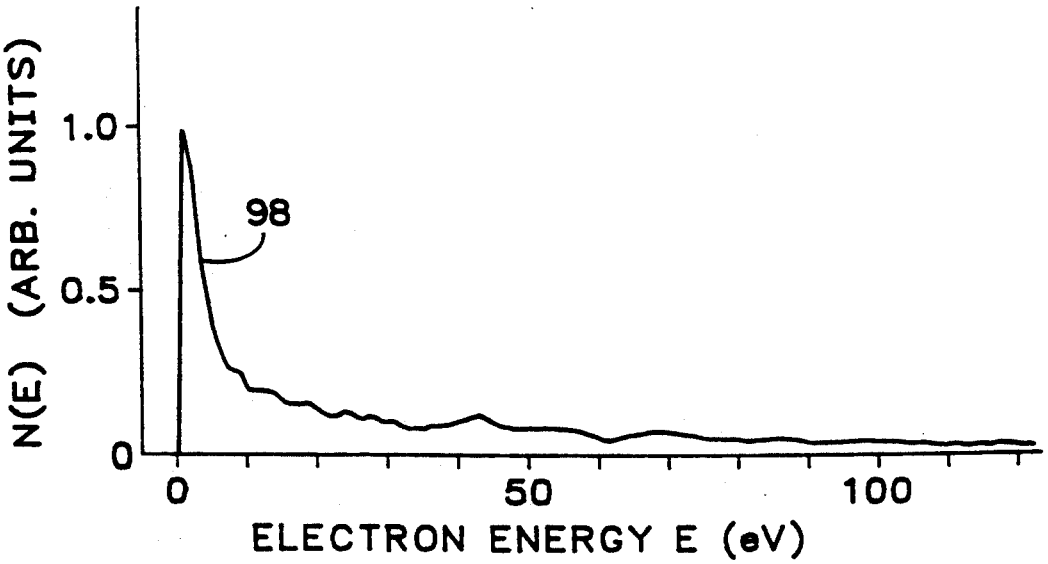
FIG. 4 (PRIOR ART)
FIG. 4 is a prior art graph of an exemplary energy distribution of the electrons emitted from a microchannel plate.

FIG. 4 shows an exemplary prior art energy distribution 98 of the electrons emitted from planar output side 86 of microchannel plate 70. Energy distribution 98 extends over a relatively wide range of energies of between zero and about 120 electron volts, with a substantial proportion of the electrons having energies of about 5 electron volts. Such a wide range of energies can cause an image to be formed on display screen 38 with chromatic aberration. In particular, electrons of higher energy directed to a point on display screen 38 strike it at a location between the point and a center location 100 at which central axis 24 intersects display screen 38. The higher energy electrons that are displaced because of chromatic aberration cause an image of a point to be formal with a "comet tail."

Since aspherical mesh element 16 reduces spherical aberration, beam limiting aperture 22 may be formed with a relatively small diameter without causing filter element 20 to block electrons emitted from different radial positions on output side 86 of microchannel plate 70. As a result, filter element 20 functions to filter out of beams 94*a* and 94*b* electrons having energies outside a preselected range of energies, thereby to reduce the chromatic aberration in the image formed on display screen 38. Beam limiting aperture 22 has a diameter of, for example, 0.5 millimeters, which causes filter element 20 to block electrons with energies greater than a threshold energy value of about ten electron volts. In addition, filter element 20 blocks electrons that strike and are scattered by mesh element 16, thereby improving the contrast of images formed on display screen 38.

Electrons with energies greater than the threshold value accelerate to a relatively high velocity in the region between output side 86 of microchannel plate 70 and mesh element 16, thereby propagating through the converging electric fields for a correspondingly short period of time. As a result, such electrons propagate along paths that would cross over central axis 24 at a location between beam limiting aperture 20 and display screen 38. Filter element 20 and the relatively small diameter of beam limiting aperture 22 function, therefore, to block such electrons and reduce the chromatic aberration in images formed on display screen 38.

It will be appreciated, therefore, that aspherical mesh element 16, filter element 20, and beam limiting aperture 22 cooperate to reduce spherical aberration and chromatic aberration sufficiently to allow projection lens assembly 10 to form a high quality image from electrons emitted by microchannel plate 70. In particular, aspherical mesh element 16 functions to reduce spherical aberration and provide an electron beam crossover of relatively small diameter. As a result, beam limiting aperture 22 may be formed with a small diameter so that filter element 20 functions to block electrons with energies greater than the threshold value, thereby reducing the chromatic aberration.

Since it emits electrons from planar output side 86, microchannel plate 70 functions as a planar electron source or cathode. Accordingly, projection lens assembly 10 may be characterized as a cathode lens for projecting electrons emitted from a planar electron source. Moreover, lens assembly 10 can be employed in a variety of systems employing a planar electron source such as a microchannel plate. For example, one type of "night-vision" device images a world scene on an infrared-sensitive photocathode that emits electrons toward a microchannel plate. Lens assembly 10 could be used in such a device to form on a display surface a demagnified image of the electrons emitted from the microchannel plate.

It will be obvious to those having skill in the art that many changes may be made to the details of the above-described preferred embodiment of the present invention without departing from the underlying principles thereof. The scope of the present invention should be determined, therefore, only by the following claims.

We claim:

1. A cathode-ray tube, comprising:

beam producing means for directing a beam of electrons generally along a central axis in the tube toward a display screen positioned near another end of the tube;

an electron multiplier including input means for receiving the beam of electrons and output means for providing in response to the beam a greater number of electrons that are in the beam, the electrons provided by the output means having an energy distribution;

deflecting means positioned between the beam producing means and the electron multiplier for deflecting the beam in a direction transverse to the beam axis to form symbology on the input means of the electron multiplier;

filter means positioned to receive the electrons provided by the output means for blocking electrons having energies outside a preselected range of energies, thereby to reduce the effects of chromatic aberration on the display screen;

projection lens means having an aspherical dome-shaped mesh element and being positioned between the electron multiplier and the display screen for projecting onto the display screen the electrons provided by the output means of the electron multiplier; and an evacuated envelope housing the beam producing means, electron multiplier, deflecting means, filter means, and projection lens means.

2. The tube of claim 1 in which the mesh element is concave as viewed from the display screen.

3. The tube of claim 1 further comprising a tubular electrode element positioned between the mesh element and the electron multiplier.

4. The tube of claim 3 further comprising biasing means for applying a potential difference between the mesh element and the tubular electrode element.

5. The tube of claim 1 in which the filter means includes a beam-limiting aperture.

6. The tube of claim 1 in which the electron multiplier includes a microchannel plate.

7. The tube of claim 1 in which the display screen has first dimensions in two directions transverse to the beam axis and the electron multiplier has second dimensions in the two directions, the first dimensions being greater than the second dimensions.

8. The tube of claim 7 in which the electron multiplier includes a microchannel plate.

9. The tube of claim 1 in which the projection lens means projects the electrons onto the display screen with a magnification greater than one, thereby to provide on the display screen a magnified rendering of the symbology formed on the input means of the electron multiplier.

10. An electrode assembly for an electron discharge device, comprising:

a planar electron source for emitting electrons having energies within a range of energy values from an electron-emitting surface of a first area;

an aspherical, dome-shaped mesh electrode element disposed in proximity to said electron source for receiving electrons therefrom; and an electron filter disposed adjacent said mesh electrode element for receiving electrons therefrom and having an aperture through which electrons having energies within a preselected portion of said first range of energy values pass, said aperture having a cross-sectional area that is smaller than said first area of said electron-emitting surface.

11. The assembly of claim 10 in which the mesh element is concave as viewed from the electron filter means.

12. The assembly of claim 10 further comprising a tubular electrode element positioned between the mesh element and the planar electron source and biasing means for applying a potential difference between the mesh element and the tubular electrode element, the tubular electrode element and biasing means cooperating with the dome-shaped mesh element to form a crossover of the electrons in alignment with the filter means.

13. The electrode assembly of claim 10, wherein said filter comprises a plate having a relatively small central aperture for transmitting electrons only within said preselected portion of said range of energy values.

14. The electrode assembly of claim 13, wherein said aperture has a diameter sized to transmit only electrons having an energy value above a preselected threshold value.

15. The electrode assembly of claim 10, wherein said mesh electrode element and electron filter means are operated at the same electrical potential.

16. An electrode assembly for an electron discharge device, comprising:

a planar electron source for emitting electrons having energies within a first range of energy values;

an aspherical, dome-shaped mesh electrode element disposed in proximity to said electron source for receiving electrons therefrom; and electron filter means disposed adjacent said mesh electrode element for receiving electrons therefrom, said filter means including blocking means for blocking the transmission of electrons having energies outside a preselected second range of energy values lying within said first range, said mesh electrode element and electron filter means being operated at a common electrical potential.

17. The electrode assembly of claim 16, wherein said blocking means comprises a plate having a relatively small central aperture for transmitting electrons only within said preselected second range of energy values.

18. The electrode assembly of claim 17, wherein said aperture has a diameter sized to transmit only electrons having an energy value above a preselected threshold value.

* * * * *

UNITED STATES PATENT AND TRADEMARK OFFICE

CERTIFICATE OF CORRECTION

PATENT NO. : 5,134,337

DATED : July 28, 1992

INVENTOR(S) : Keith F. Kongslie, Gary A. Nelson, Duncan F. Hughes

It is certified that error appears in the above-identified patent and that said Letters Patent is hereby corrected as shown below:

Claim 1, Col. 6, Line 12, "that" thould be "than".

Claim 10, Col. 7, Line 3, delete "first".

Signed and Sealed this

Twenty-first Day of September, 1993

Bruce Lehman

*Attest:*

BRUCE LEHMAN

*Attesting Officer*

*Commissioner of Patents and Trademarks*